United States Patent [19]

Van Fossen

[11] 4,001,984

[45] Jan. 11, 1977

[54] METHOD FOR FINISHING PARTS

[75] Inventor: Harvey Van Fossen, Mishawaka, Ind.

[73] Assignee: Wheelabrator-Frye, Inc., Mishawaka, Ind.

[22] Filed: June 6, 1975

[21] Appl. No.: 584,485

Related U.S. Application Data

[62] Division of Ser. No. 418,556, Nov. 23, 1973, Pat. No. 3,918,212.

[52] U.S. Cl. ..... 51/313

[51] Int. Cl.[2] ..... B24B 31/06

[58] Field of Search ..... 51/163, 313–316; 241/175

[56] References Cited

UNITED STATES PATENTS

| | | | |
|---|---|---|---|
| 2,819,849 | 1/1958 | Becker | 241/175 |
| 3,197,922 | 8/1965 | Smith | 51/163 |
| 3,210,891 | 10/1965 | Joy | 51/163 |
| 3,337,997 | 8/1967 | Rampe | 51/163 |
| 3,392,925 | 9/1968 | Moore | 51/163 X |
| 3,611,638 | 10/1971 | Deede | 51/163 X |
| 3,792,552 | 2/1974 | Isaacson | 51/163 |

FOREIGN PATENTS OR APPLICATIONS

| | | | |
|---|---|---|---|
| 159,435 | 4/1962 | U.S.S.R. | 51/163 |

*Primary Examiner*—Harold D. Whitehead
*Attorney, Agent, or Firm*—McDougall, Hersh & Scott

[57] ABSTRACT

A method and apparatus for finishing parts is disclosed. The apparatus includes a pair of concentric circular members of different radii having a horizontal axis resiliently mounted to a base for orbital vibration. Parts and a finishing media are introduced into a closed annular chamber defined by the area between the circular members. Orbital vibration causes the parts and media to move in a helical path having a substantially vertical plane around the inner member to a discharge opening. At the discharge opening the parts are separated from the media, which is then classified and portions thereof are returned to the chamber. A motor driven eccentric shaft mounted co-axially of the circular members produces the orbital motion.

3 Claims, 9 Drawing Figures

METHOD FOR FINISHING PARTS

This is a division, of application Ser. No. 418,556 filed Nov. 23, 1973, and now U.S. Pat. No. 3,918,212 issued Nov. 11, 1975.

BACKGROUND OF THE INVENTION

The present invention relates to vibratory devices of the type wherein blanks or parts and finishing media are introduced into a container which is vibrated for the purpose of surface treating the parts. Typical operations which are performed in this manner are: polishing or burnishing of metal; or cleaning, abrading and deburring of the surface of parts using abrasive finishing media placed in intimate contact with the parts.

In the case of conventional vibratory finishing devices, circular or elongate U-shaped bowls have generally been employed. When the bowl is vibrating, the parts and media travel in an orbital path along a generally horizontal plane. In a preferred arrangement, means are provided for receiving the parts and media during an upper portion of their travel to enable separation of the parts from the media and return of the media by gravity to the bowl for re-use. Finishing apparatus of the type described is illustrated in U.S. Pat. No. 3,693,298 to Ferrara; U.S. Pat. No. 3,100,088 to Podmore et al.; and U.S. Pat. No. 3,676,958 to Garland.

In such vibratory devices, very little relative motion between the media and parts occurs during certain portions of their travel together. The less the amount of relative movement between the media and parts, the longer it takes to complete the desired finishing operation. Another drawback of conventional vibratory equipment is their requirement to make use of media having a density within the range of 35 to 300 pounds per cubic foot. Since the metal surface removal rate is somewhat proportional to the weight and size of the media, such limitation on the media is undesirable.

Another type of prior vibratory device utilizes a bowl shaped container in which the parts and media are caused to move in a generally vertical plane. The movement is guided either by guide baffles or rotating arms within the bowl. Examples of such devices include U.S. Patent No. RE 27,084 to Balz and U.S. Pat. No. 3,611,638 to Deede. Such devices apply the vibrational energy to the parts from only one direction or require the use of a complicated rotating arm.

It is, accordingly, an object of the present invention to provide a vibrational method in which vibrational is applied energy to the media and parts throughout their entire travel through the device to maximize relative motion between the parts and media.

It is another object of the present invention to provide a vibratory method which has an increased material removal rate.

It is a further object of the present invention to provide a method which maintains the media and parts in pressure contact for increased material removal.

It is a still further object of the present invention to provide a method in which the parts can be accurately positioned in the media due to the continuous rotation of the media in helical, non-crossing paths.

It is a further object to provide a vibratory device which is not limited to the traditional range of media density.

It is a still further object to provide a method which is also capable of continuously scrubbing sand used in mold-making to remove the coating resulting from the molding process.

Other objects of the invention will become apparent from the concluding portion of the specification.

SUMMARY OF THE INVENTION

A vibratory device for the surface finishing of parts includes a base having a pair of concentric circular members of different radii having a horizontal axis resiliently mounted thereon. The circular members have their ends connected to form a closed annular chamber therebetween. The parts and media are introduced into the chamber through an opening in the outer member of the pair. A motor drives an eccentric shaft mounted co-axially of the members for causing orbital motion thereof. The induced orbital motion causes the parts and media in the chamber to move in a helical path around the inner member in a substantially vertical plane, toward a discharge means located at one end of the cylinders.

On reaching discharge means the parts and media are separated and the media is classified according to a physical characteristic thereof. Selected portions of the media are returned to the chamber for re-use.

DETAILED DESCRIPTION

Figure 1:
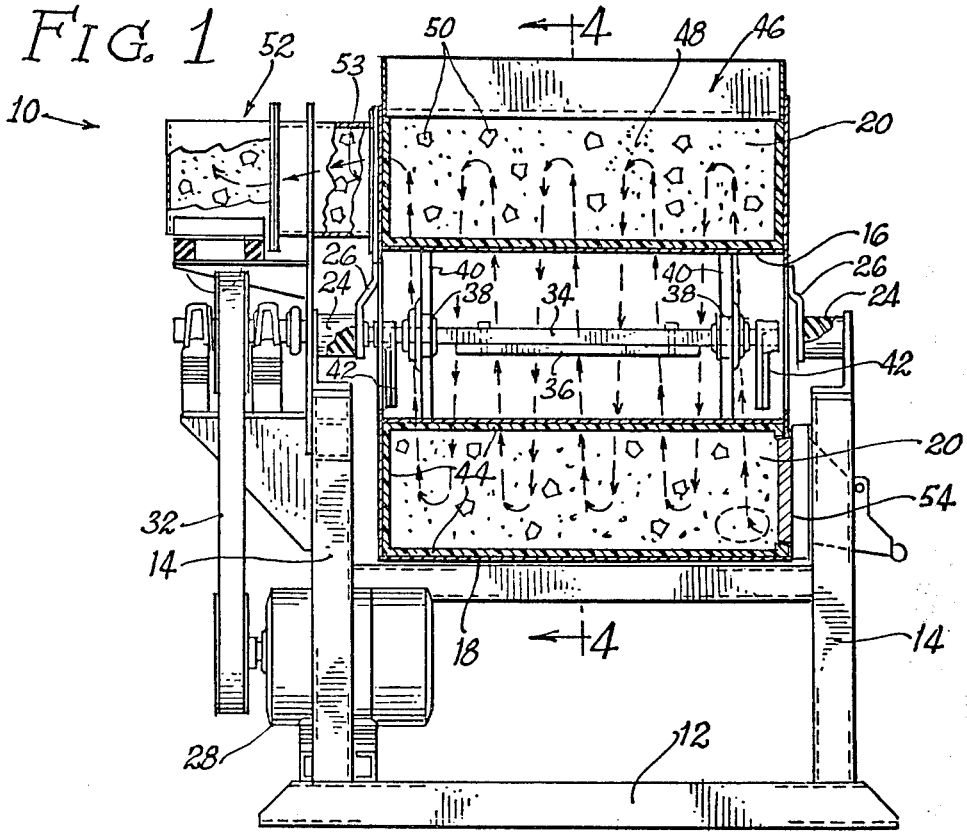
FIG. 1 is a longitudinal section of the vibrational device according to the present invention showing the chamber formed between the inner and outer concentric members.
Figure 2:
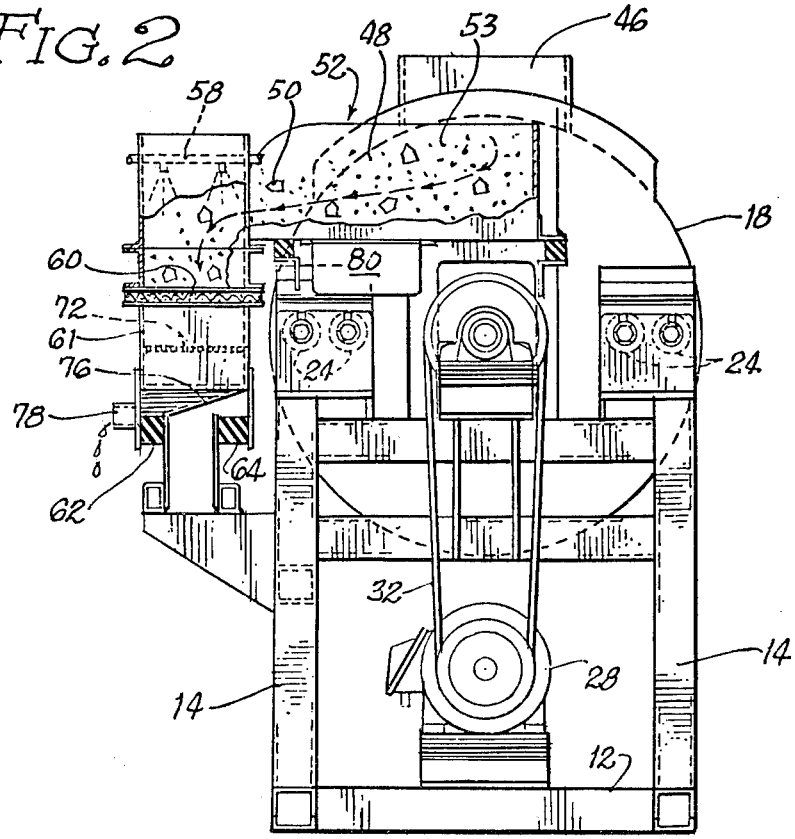
FIG. 2 is an end view of the vibrational device having portions cut away.

Referring now to FIGS. 1 and 2, a vibrating device 10 according to the present invention is shown. The device 10 includes a base 12 having vertical support members 14 attached thereto. Mounted on the vertical support members is a structure comprising a pair of concentric circular members 16 and 18 of different radii. Members 16 and 18 have a horizontal axis and have their ends connected to define a closed annular chamber 20 therebetween.

Figure 8:
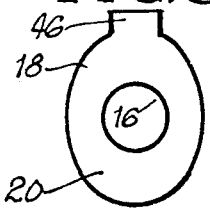
FIG. 8 is a transverse section of a pair of circular members comprising an oval outer member and a cylindrical inner member.
Figure 9:
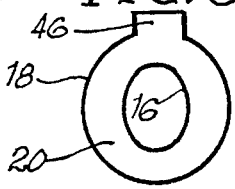
FIG. 9 is a transverse section of a pair of circular members comprising a cylindrical outer member and an oval inner member.

While the circular members 16 and 18 are illustrated as concentric cylinders in FIGS. 1–4, it will be apparent that other concentric circular members of different radii and having a horizontal axis can be employed, as illustrated in FIGS. 5–9. For example, an elongated doughnut-shaped (toroidal) member, (FIGS. 5 and 6), a serpentine member (FIG. 7) or oval members (FIGS. 8 and 9)

The alternate circular members illustrated in FIGS. 5–9 operate in the manner to be described in connection with FIGS. 1–4. However, the shape variation is effective to provide variable movement of the parts and media within the annular chamber 20. For example, as the mixture moves in a helical path between the serpentine shaped circular members of FIG. 7, the vibrational energy transmitted to the mixture varies with the thickness of the chamber 20. Similarly, the vibrational energy varies in the oval shaped members of FIGS. 8 and 9.

This refinement permits, in combination with multiple sized media, a coarse, medium and fine finishing action on the parts, should such be desired.

The circular members are mounted to the vertical support members 14 by four resilient shear mounts 24 and mounting members 26. The members are thus able to vibrate on the mountings.

A motor 28 mounted on base 12 is utilized for producing vibratory motion in the circular members. Its drive shaft 30 is connected by a belt 32 to an eccentric shaft 34 mounted co-axially of the members 16 and 18. The shaft 34 may have a round or square cross-section as desired. However, a square cross-section in its central portion facilitates the mounting of a counterweight 36 thereto. The shaft is supported for rotation in bearings 38, which are rigidly connected to the inner member 16 by struts 40. A pair of adjustable counterweights 42 mounted to the shaft 34 permit adjustment of the amplitude of the vibratory motion imparted to the circular members.

The annular chamber 20, comprising the enclosed area between the members 16 and 18, may have a polyurethane or other suitable replaceable lining 44 to enhance the action of the media on the parts to be finished. Media 48 and parts 50 are introduced into the annular chamber 20 through an opening 46 in the outer member 18. When the motor 28 causes rotation of the shaft 34, the circular members are caused to vibrate, producing an orbital motion within the chamber 20. As indicated schematically by the dashed arrows in FIG. 1, and as clearly illustrated in FIG. 4, this orbital motion causes the mixture of media and parts to follow a helical path around the inner member 16 in a substantially vertical plane.

Located at one end of the circular member is a discharging means 52. This discharging means includes an opening 53 communicating with the chamber 20. As the mixture of parts and media reach the opening 53 they pass outwardly from the chamber and are processed in a manner to be subsequently described. As will be recognized by those skilled in the art, the length of time required for a part to travel through the chamber 20 will be determined by the amplitude of vibratory motion imparted to the circular members and by the location at which the part is introduced into the chamber. Introducing the parts further from discharge means 52 increases the time they remain in the chamber 20.

Although helical motion of the parts and media is preferred so that a continuous operation is possible, it is also contemplated to operate the device as a batch processer. For batch processing, parts can be introduced into the chamber 20 and by adjusting the eccentricity of the shaft the media and parts can be made to travel a completely circular path around and around in the chamber 20 with no horizontal displacement. After the parts have achieved a desired finish they can be removed from the chamber through the opening 46 or the discharge means.

Located at the end of the circular members, near a bottom portion thereof opposite the discharge means 52, is a media drain 54 for removing the contents of the chamber for cleaning, relining or other maintenance operations.

Figure 3:
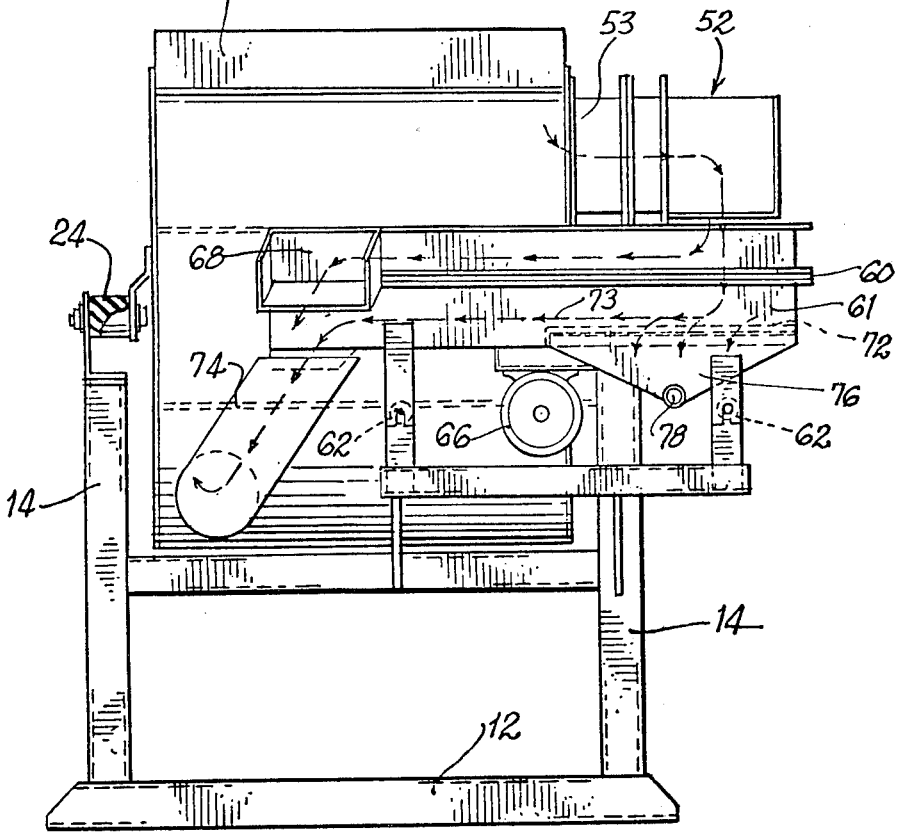
FIG. 3 is a side view of the vibrational device according to the present invention showing the discharge means.
Figure 5:
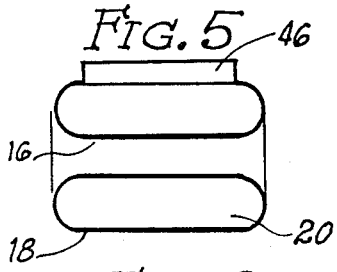
FIG. 5 is a longitudinal section similar to FIG. 1 of a pair of circular members which comprise an elongated toroid.
Figure 6:
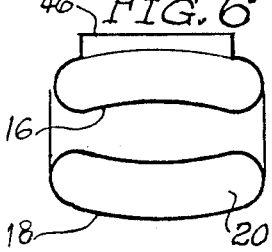
FIG. 6 is a longitudinal section of a pair of circular members which comprise an elongated toroid having a longitudinal curve.
Figure 7:
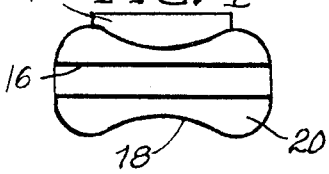
FIG. 7 is a longitudinal section of a pair of circular members which define a serpentine-like chamber therebetween.
Figure 4:
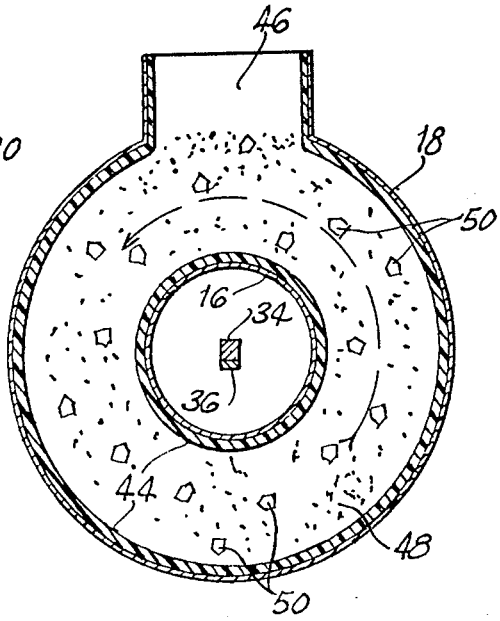
FIG. 4 is a cross-sectional view of the circular members taken along the lines 4—4 of FIG. 1.

Referring now to FIGS. 2 and 3, the details of the discharge means 52 will be described. As the mixture of media 48 and parts 50 discharges from the chamber 20 through opening 53, it is deposited onto a separating screen 60. Simultaneously the mixture is subjected to a liquid shower 58 for facilitating the separation of the parts from the media. The part being substantially larger than the media, separation is effected by selecting an appropriate mesh size for screen 60 to permit the media to pass downwardly through the screen to a chamber 61.

The separating screen 60 and the chamber 61 are isolated from the vibrational motion of the circular members by shear mounts 62 and 64. An independent vibrational system is provided for effecting separation of the parts and media including a motor and an eccentric fly wheel 66 mounted to the underside of chamber 61. As the media and parts pass on to the classifying screen 60, they are subject to vibration from the eccentric fly wheel 66. The parts travel along the screen 60 due to the vibration, until they reach a discharge chute 68, where they are transferred to conveying means for further processing. The media passes downwardly into the chamber 61 onto a second classifying screen 72 disposed therein. Media which is too large to pass through the classifying screen 72 is vibrated along the path indicated by the arrows 73 to a duct 74 communicating with the annular chamber 20. Thus media of a predetermined minimum size is returned to the chamber 20 for re-use. Media, which through repeated usage has become small enough to pass through the classifying screen 72, is collected in a V-shaped trough 76 along with the liquid from the shower 58. This waste fluid mixture is removed from the device through a drain pipe 78 to appropriate disposal means.

Referring to FIG. 2, a third vibratory device 80, of standard design, is mounted to the underside of discharge opening 53 to increase the flow rate of parts and media as they are discharged from the chamber 20 onto the classifying screen 60.

Briefly reviewing operation of the device, it will be apparent that media and parts which are to receive surface treatment are introduced into the annular chamber 20 through opening 46. The motor 28 causes rotation of the eccentric shaft 34 producing orbital motion of the cylindrical assembly. Such motion causes energy to be transmitted to the material within the annular chamber 20 from both the inner circular member 16 and the outer member 18. This vibrational energy causes the media and parts to move relative to each other for surface treatment of the parts and further causes the mixture to travel a helical path around and around the inner member until it reaches the discharge end of the assembly.

When the mixture is discharged, it travels over a separating screen 60 which permits the media, but not the parts, to pass downwardly into a chamber 61. The finished parts are delivered to a discharge chute 68.

The media is further classified by a second screen 72, portions of which are returned to the annular chamber 20 for re-use, while the balance is discharged through drain pipe 78.

While the above description represents the primary use of the present invention, it can also be employed for scrubbing sand to remove the coating which results from the molding processes employed in making the parts. For such purposes, the sand is fed into the chamber 20 and allowed to travel therethrough to the discharge means. The vibratory action of the device is effective to scrub the sand and remove the molding binder permitting the sand to be re-used in the molding process.

While I have shown and described an embodiment of this invention in some detail, it will be understood that this description and illustration are offered merely by way of example, and that the invention is to be limited in scope only by the appended claims.

I claim:

1. A method of surface finishing parts comprising the steps of: introducing parts and finishing media into an upper portion of a closed annular chamber defined by a pair of horizontally oriented concentric circular members of different radii; vibrating said chamber to produce orbital motion therein for causing said parts and media to move circumferentially within said chamber; discharging said parts and media from said chamber at said upper portion; and separating said parts from said media including the sub-steps of classifying the media according to a physical characteristic thereof, and returning selected portions of the media to said chamber at a bottom portion thereof by vibrational and gravitational force.

2. The method of claim 1 wherein said parts and media move in a helical path in said chamber in a substantially vertical plane.

3. The method of claim 1 wherein said parts and media move in a circular path in said chamber in a substantially vertical plane.

* * * * *